US010249978B2

(12) United States Patent
Dean

(10) Patent No.: US 10,249,978 B2
(45) Date of Patent: Apr. 2, 2019

(54) MODULAR CONNECTOR WITH CARRIER HAVING AN APERTURE FORMED ON CROSS MEMBER

(71) Applicant: Molex, LLC, Lisle, IL (US)

(72) Inventor: Paul Shannon Dean, Auburn Hills, MI (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/741,872

(22) PCT Filed: Jul. 25, 2016

(86) PCT No.: PCT/US2016/043868
§ 371 (c)(1),
(2) Date: Jan. 4, 2018

(87) PCT Pub. No.: WO2017/019605
PCT Pub. Date: Feb. 2, 2017

(65) Prior Publication Data

US 2018/0205171 A1 Jul. 19, 2018

Related U.S. Application Data

(60) Provisional application No. 62/198,209, filed on Jul. 29, 2015.

(51) Int. Cl.

| | |
|---|---|
| ***H01R 13/518*** | (2006.01) |
| ***H01R 13/514*** | (2006.01) |
| ***H01R 13/504*** | (2006.01) |
| ***H01R 12/58*** | (2011.01) |
| ***H01R 13/52*** | (2006.01) |

(52) U.S. Cl.
CPC ..... *H01R 13/518* (2013.01); *H01R 12/585* (2013.01); *H01R 13/504* (2013.01); *H01R 13/514* (2013.01); *H01R 13/5202* (2013.01)

(58) Field of Classification Search
CPC .. H01R 13/518; H01R 13/514; H01R 13/504; H01R 13/52; H01R 13/5202; H01R 13/5205; H01R 13/5208
USPC ..... 439/587, 571, 540.1, 541.5, 334, 668, 439/669, 676
See application file for complete search history.

(56) References Cited

U.S. PATENT DOCUMENTS 3,825,800 A * 7/1974 Warman ..... H02B 1/04 361/837
5,145,410 A * 9/1992 Maejima ..... H01R 13/5208 439/274
5,328,388 A 7/1994 Fust et al.
(Continued)

FOREIGN PATENT DOCUMENTS

JP 2000-150058 A 5/2000

*Primary Examiner* — Harshad C Patel
(74) *Attorney, Agent, or Firm* — Molex, LLC

(57) ABSTRACT

A connector assembly is provided that includes a carrier embedded within a molded frame. The carrier further includes an aperture positioned within an opening formed in the carrier configured to receive a boss formed on a connector housing. A connector module having a plurality of electrical terminals retained in the housing and secured to the frame. The connector module aligned to the frame by the carrier by the boss formed in the housing engaging the aperture. The carrier adding rigidity to the frame and providing a precise alignment of the connector modules to the frame.

15 Claims, 14 Drawing Sheets

(56) References Cited

U.S. PATENT DOCUMENTS

| | | | | |
|---|---|---|---|---|
| 5,709,563 | A * | 1/1998 | Saito | H01R 13/5208 439/275 |
| 6,599,153 | B2 * | 7/2003 | Nishide | H01R 13/6456 439/271 |
| 7,591,667 | B2 * | 9/2009 | Gatnau Navarro | G01R 31/041 361/736 |
| 8,645,132 | B2 * | 2/2014 | Mozer | G10L 15/063 704/233 |
| 9,130,298 | B1 * | 9/2015 | Baydoun | H01R 13/516 |
| 2002/0002000 | A1 * | 1/2002 | Okamura | H01R 13/5208 439/587 |
| 2002/0039862 | A1 | 4/2002 | Nishide | |
| 2002/0086575 | A1 | 7/2002 | Marpoe, Jr. et al. | |
| 2004/0209515 | A1 * | 10/2004 | Caveney | H01R 13/518 439/540.1 |
| 2008/0266206 | A1 * | 10/2008 | Nelson | G09F 9/33 345/1.3 |
| 2009/0053923 | A1 * | 2/2009 | Navarro | G01R 31/041 439/489 |
| 2010/0267270 | A1 * | 10/2010 | Jehmlich | H01R 13/42 439/357 |
| 2010/0317239 | A1 | 12/2010 | Achammer et al. | |
| 2012/0077377 | A1 * | 3/2012 | Han | B29C 45/2628 439/587 |

* cited by examiner

MODULAR CONNECTOR WITH CARRIER HAVING AN APERTURE FORMED ON CROSS MEMBER

RELATED APPLICATIONS

This application is a national stage of International Application No. PCT/JP2015/065074, filed May 26, 2015, which claims priority to U.S. Provisional Application No. 62/198,209, filed Jul. 29, 2015, both of which are incorporated herein by reference in their entirety.

FIELD OF THE DISCLOSURE

The present disclosure relates to field of electrical connectors in particular to modular electrical connectors for securing a plurality of connector modules.

DESCRIPTION OF RELATED ART

The present disclosure generally relates to a modular electrical terminal connector and, more specifically, to an electrical connector for a connector system that can be used in a vehicle. In general, modular connectors of this type are suitable for use in vehicle systems including junction distribution blocks, power control modules and other body control systems. These systems typically employ a molded housing with multiple receiving bays formed in the housing along a length of the connector and having a plurality of electrical terminals secured within each bay for connection to corresponding plug connectors.

BRIEF SUMMARY

A connector system is provided that includes a receptacle connector including an elongated housing with a plurality of receiving bays formed therein. A plurality of electrical terminals is secured in each of the receiving bays with each terminal including a connecting end and a mounting end. The portions of the electrical terminals extending from the mounting end include tails with a compliant section for mounting on a printed circuit board. A plug connector is formed from an insulative material and is configured to mate with a corresponding receiving bay formed in the receptacle. Each plug includes an electrical terminal secured therein and adapted for mating with a corresponding electrical terminal of each terminal in respective receiving bays.

In the embodiment of the present disclosure, the receptacle connector includes a frame formed from a moldable material and includes a plurality of openings formed along the length of the connector. Each opening receives an individual connector module secured in each respective opening with each of the modules including a plurality of electrical terminals retained in each module. The frame further includes a carrier used to position the modules within the frame and to maintain true position of the connectors. The carrier also acts as a stiffener to prevent the frame from bowing and bending and also improving the true position of the connector modules within the frame.

With increased electrical content in vehicles, larger connectors and more circuits connecting onboard systems, higher density connectors are required. With the increased number of connectors, especially in distribution blocks and engine control modules, it is necessary to have these modules in precise alignment to minimize electrical failures due to improperly mated connectors and/or improper or incomplete connection of the receptacle to the printed circuit board. One can appreciate a connector that provides greater precision in aligning these connectors together in these applications.

BRIEF DESCRIPTION OF THE DRAWINGS

The present disclosure is illustrated by way of example, and not limited, in the accompanying figures in which like reference numerals indicate similar elements and in which.

DETAILED DESCRIPTION

Figure 1:
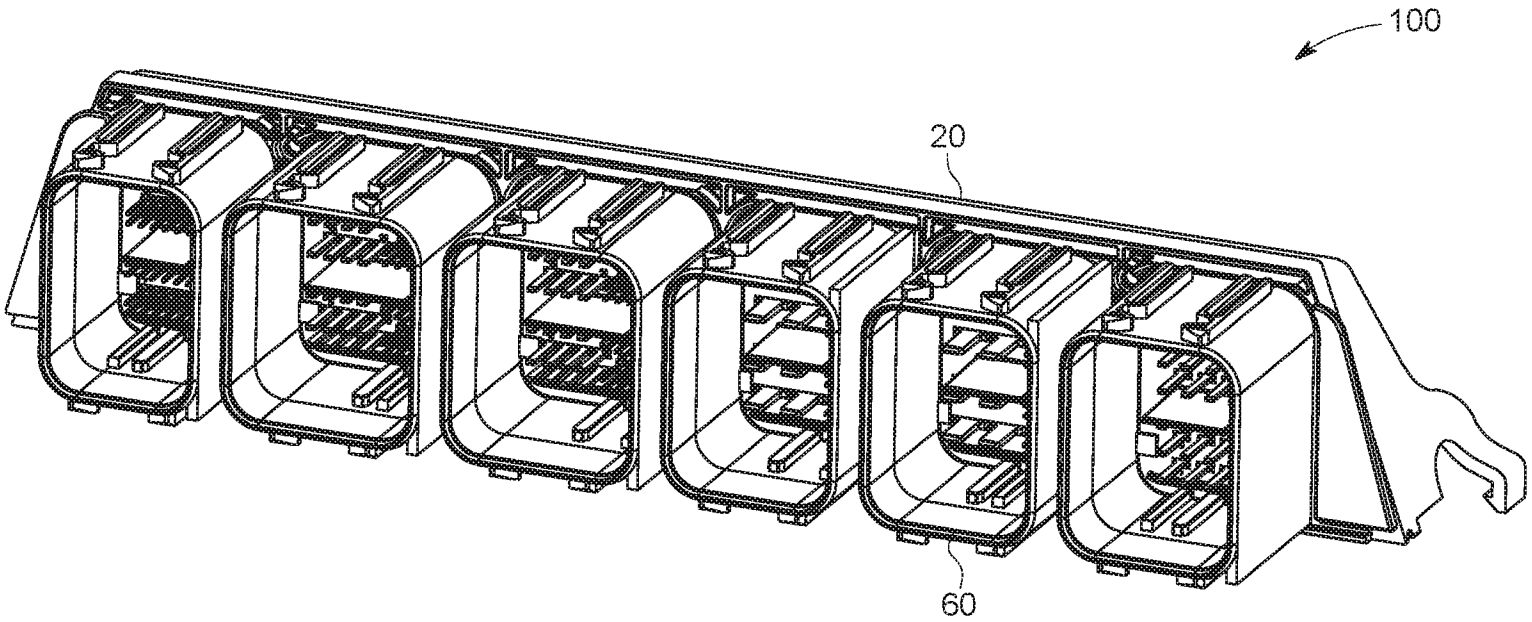
FIG. 1 is a perspective view of the connector.
Figure 2:
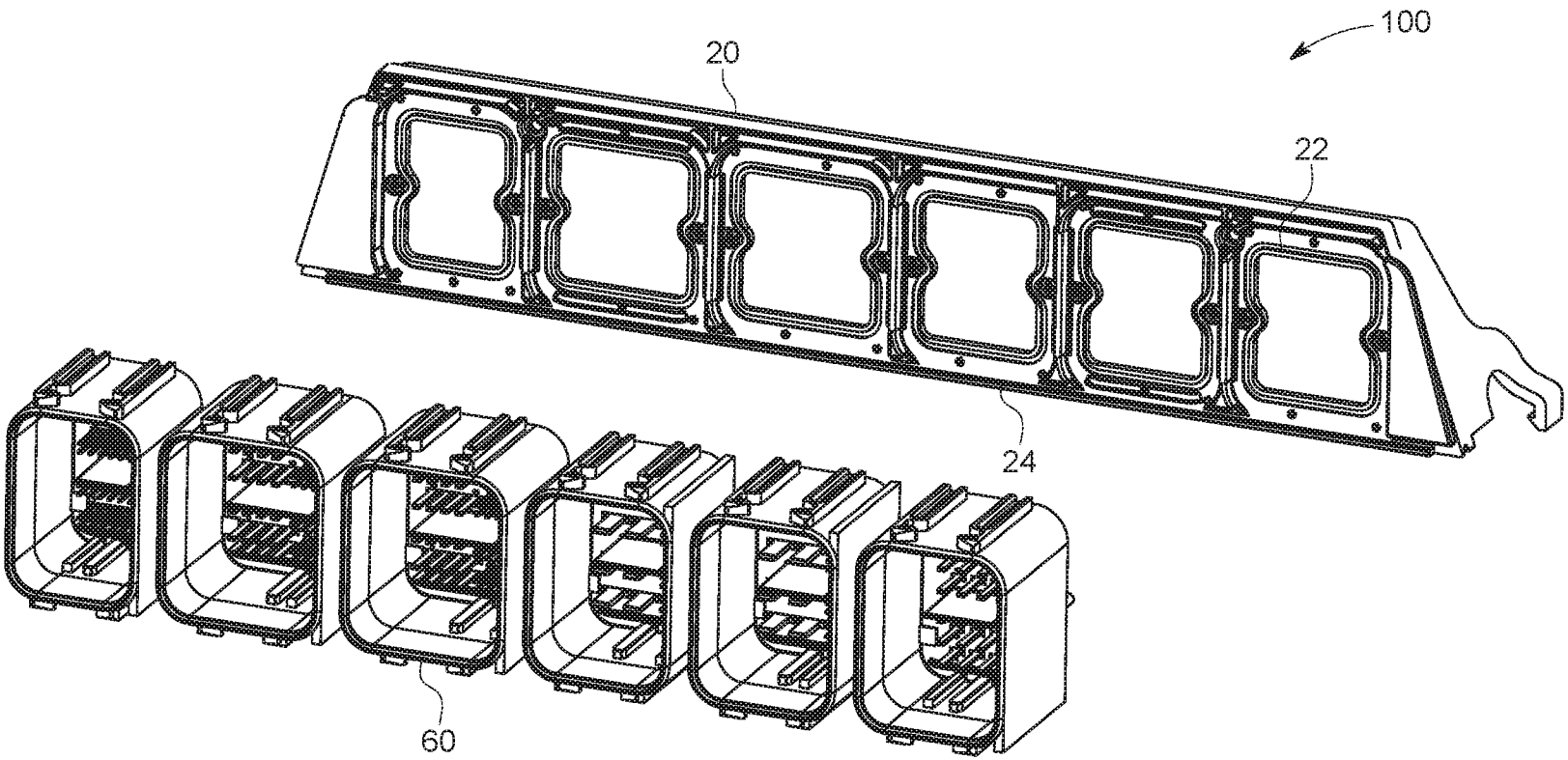
FIG. 2 is a perspective view of the connector of FIG. 1 with the connector modules removed from the frame.

The appended figures illustrate an embodiment of the present disclosure and it is to be understood that the disclosed embodiment is merely exemplary of the disclosure, which may be embodied in various forms. Therefore, specific details disclosed herein are not to be interpreted as limiting, but merely as a basis for the claims and as a representative basis for teaching one skilled in the art to variously employ the present disclosure.

As best shown in FIGS. 1-6 a connector 100 includes a frame 20 and a connector module 60. The frame 20 is generally formed from an insulative material by a molding process and includes an elongated body portion with a plurality of openings 22 positioned along its length. A carrier 30 is insert molded within the frame 20 and is constructed from a rigid material generally metal. A plurality of connector modules 60 are secured to the frame 20 completing the connector assembly 100.

Figure 3:
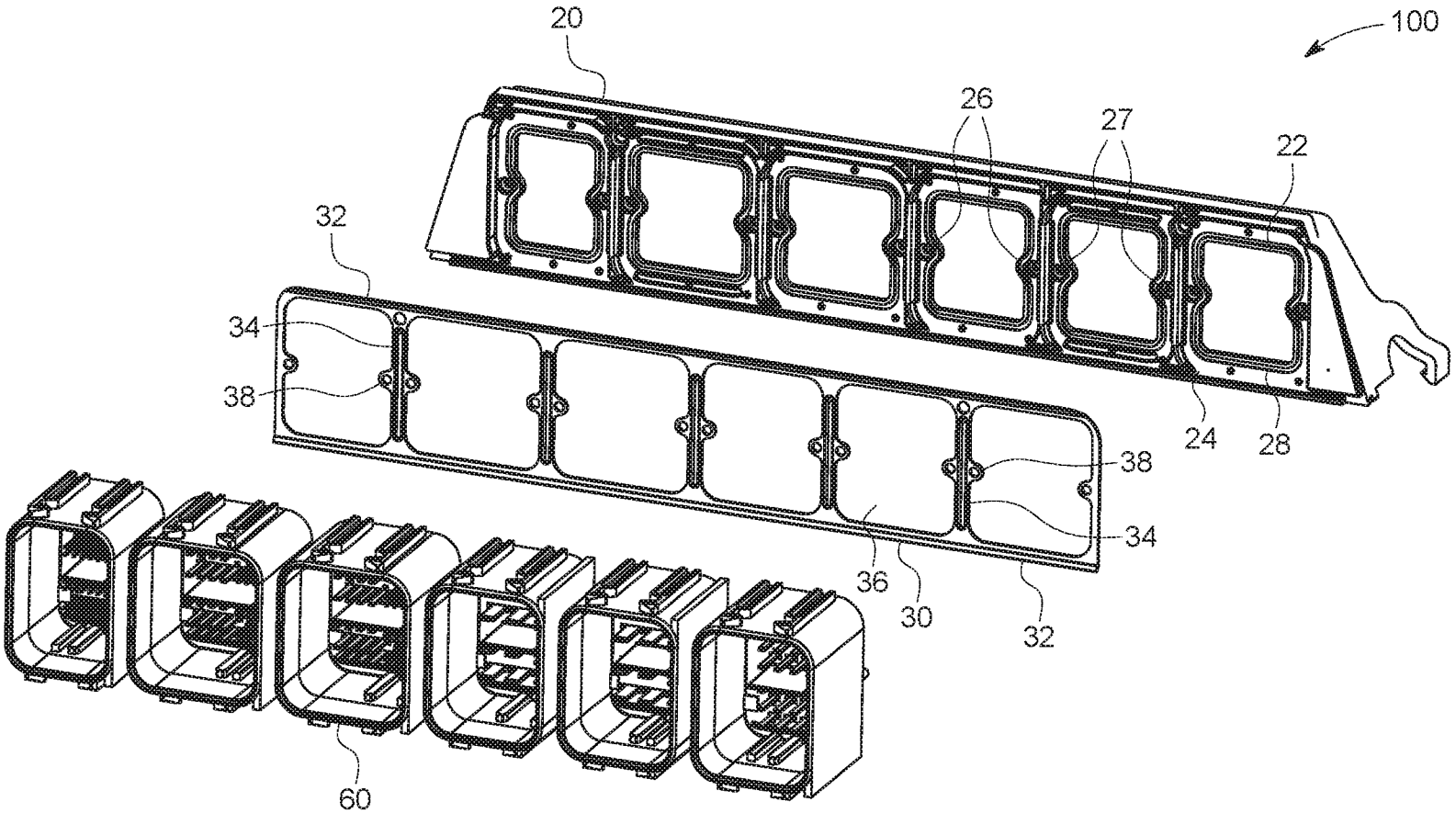
FIG. 3 is an exploded view of the connector of FIG. 1.
Figure 4:
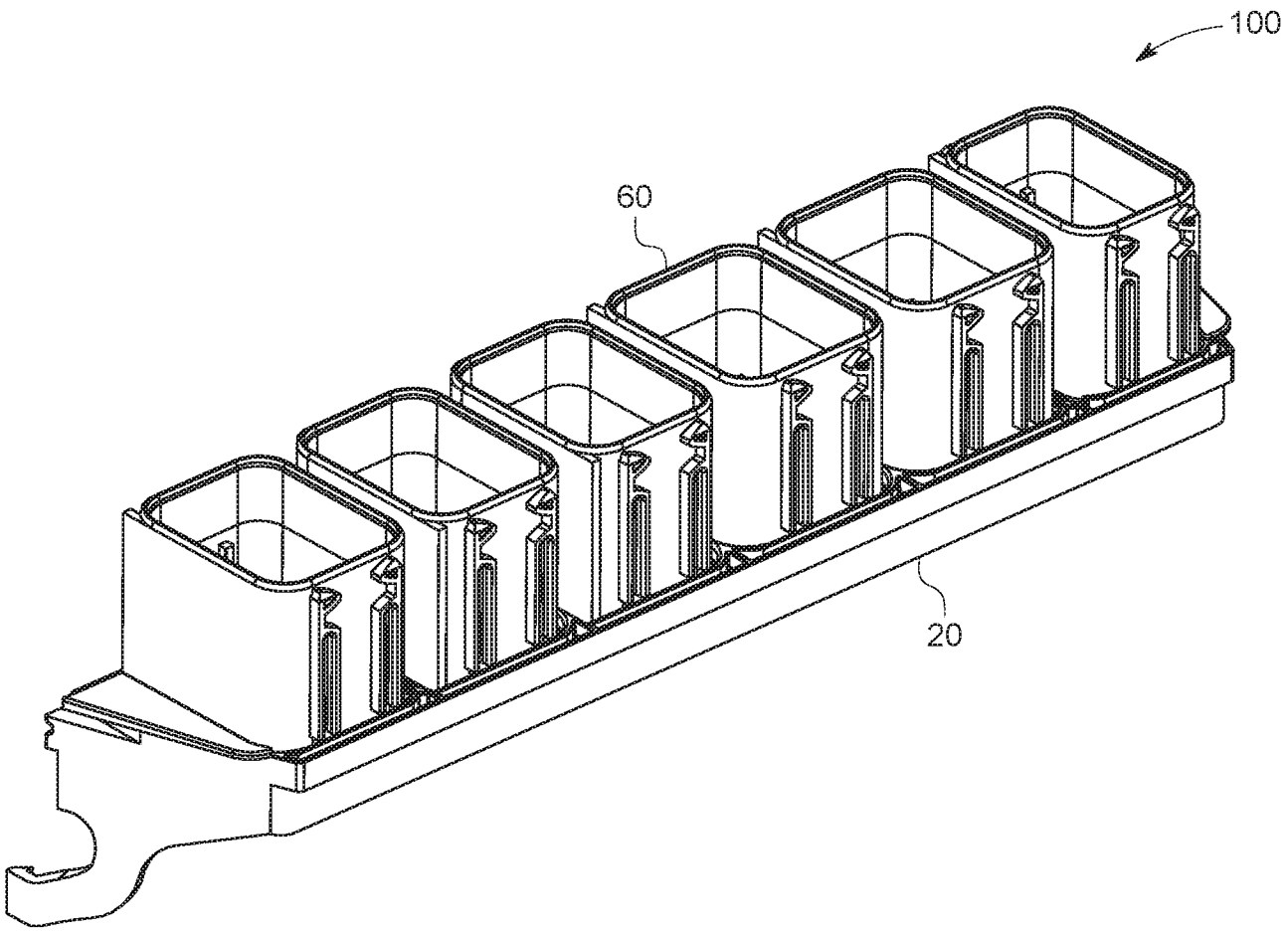
FIG. 4 is an alternative perspective view of the connector of FIG. 1.
Figure 5:
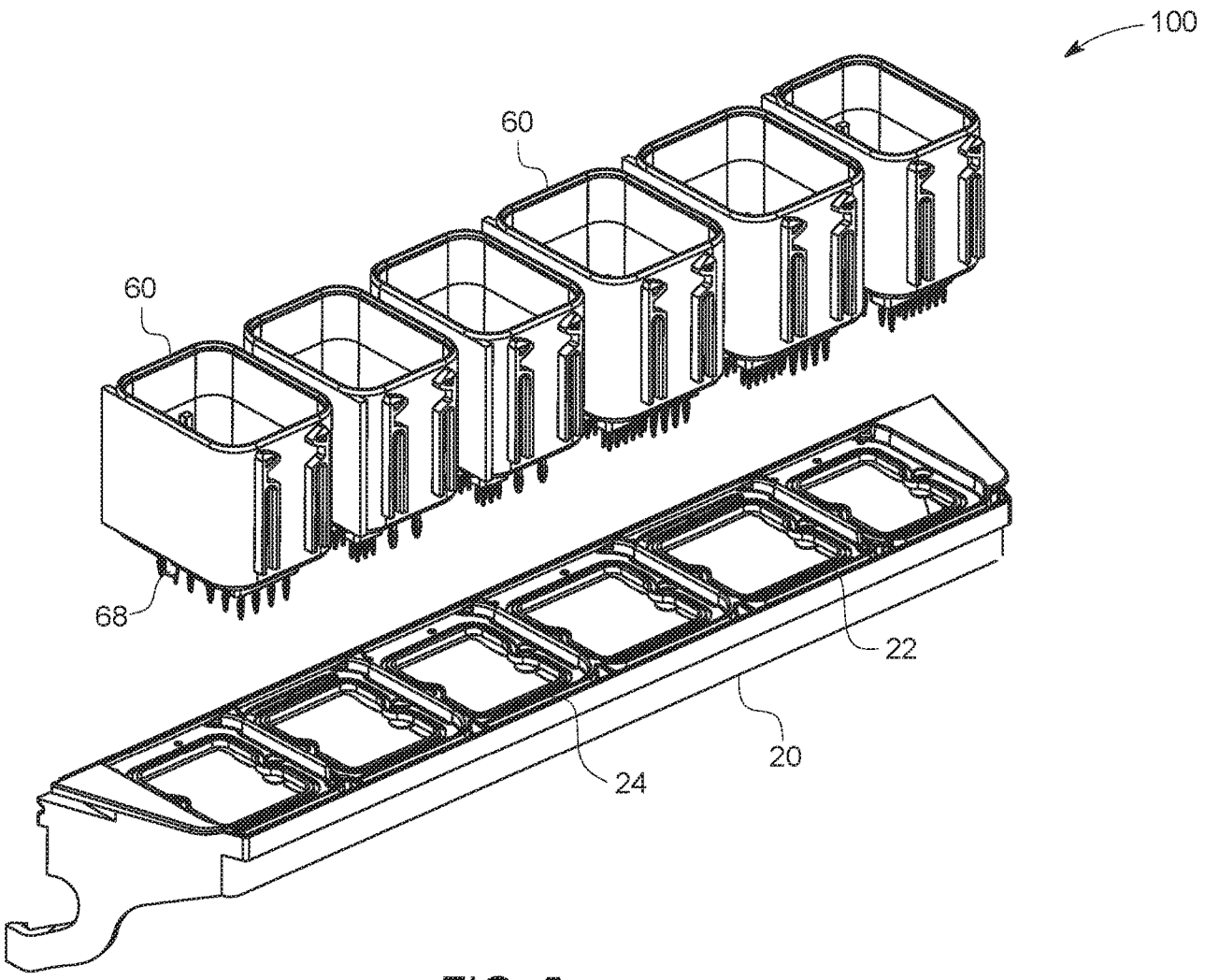
FIG. 5 is an alternative perspective view of the connector of FIG. 2.
Figure 6:
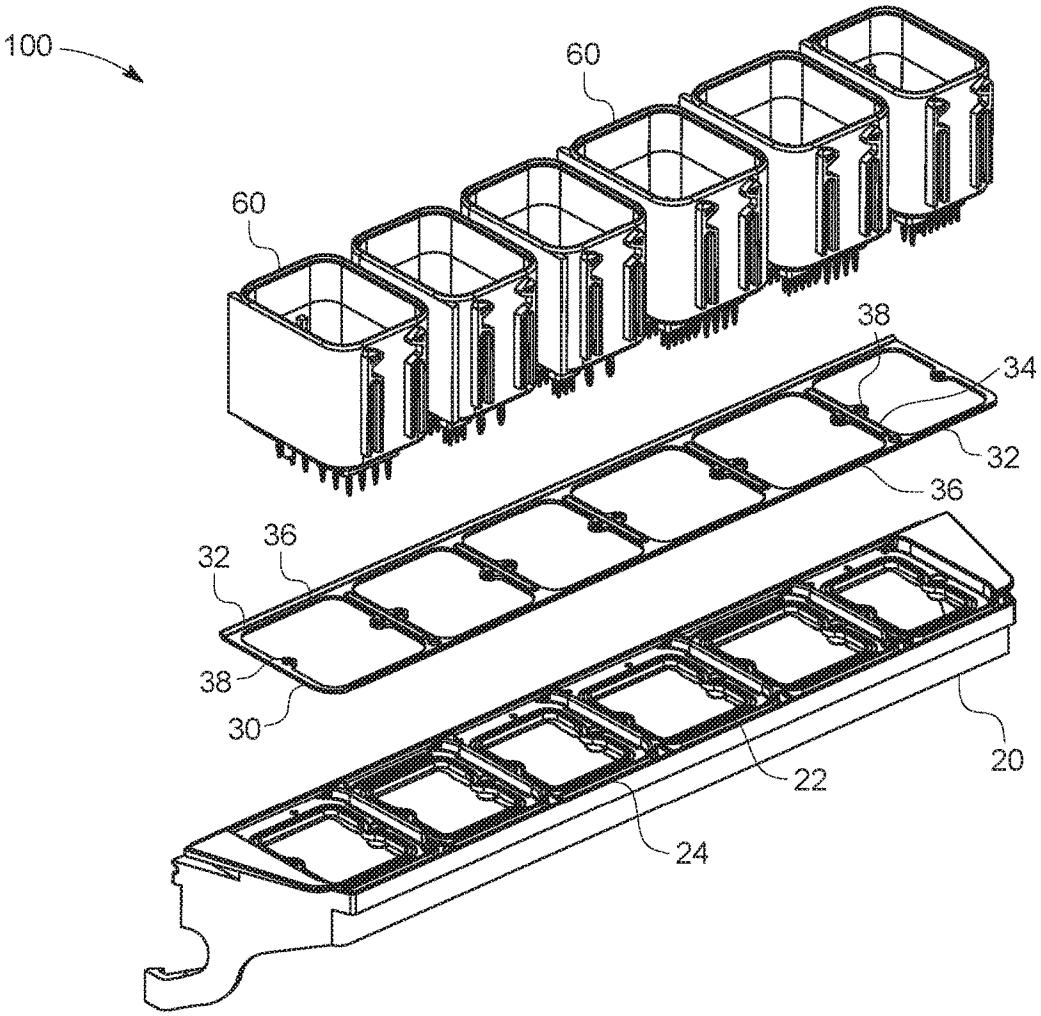
FIG. 6 is an alternative perspective view of the connector of FIG. 3.

As best illustrated in FIG. 3 the frame 20 is generally molded from an insulative material and includes an elongated body portion with a plurality of receiving bays 24 formed along its length and each receiving bay 24 includes an opening 22 extending through the frame 20. Each receiving bay 24 includes an opening 22 and a pair of ears 26 extending from a side of the opening 22 into the interior portion of the opening 22. Each ear 26 includes a circular aperture 27 having a center axis formed therein. Each opening 22 includes a peripheral surface including a lip 28 for abutting a corresponding surface formed a connector module 60.

Figure 7:
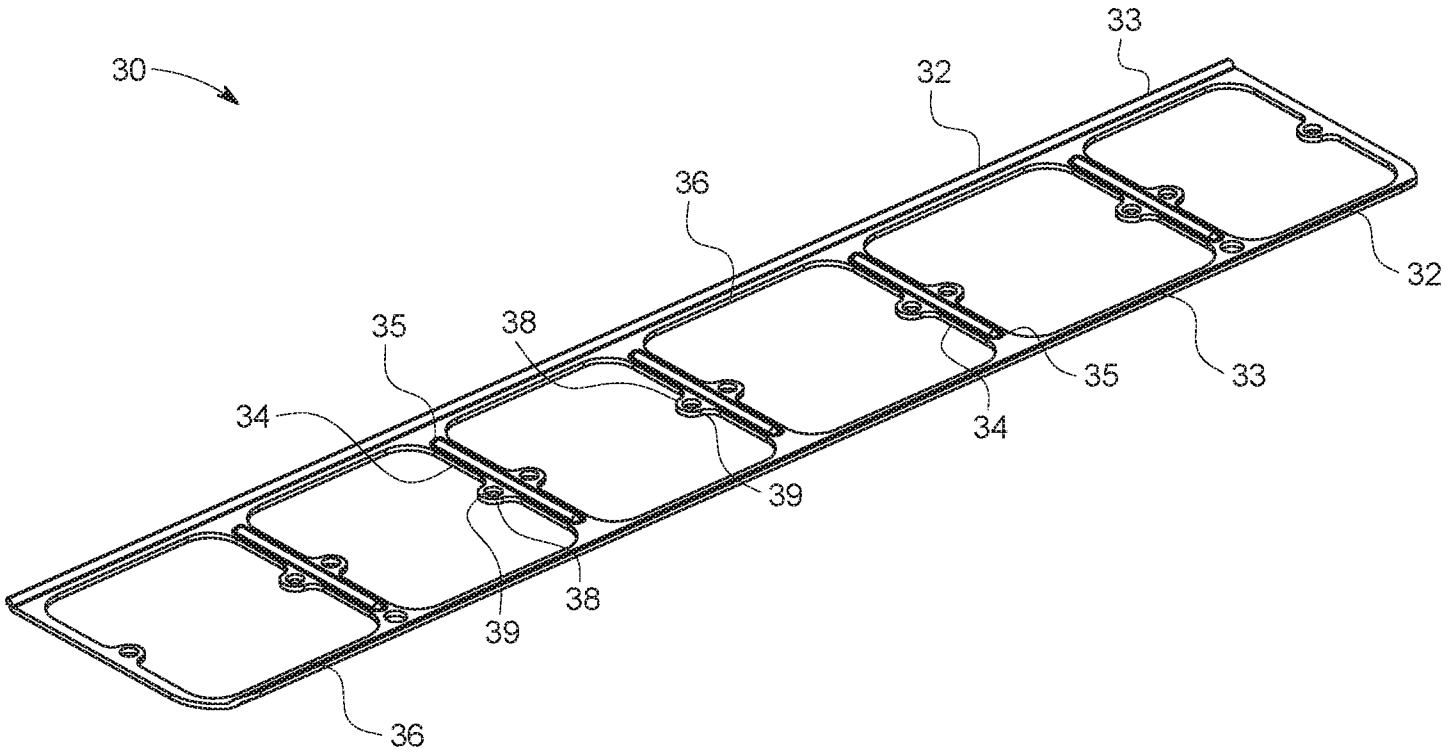
FIG. 7 is a perspective view of the carrier of the connector of FIG. 1.
Figure 8:
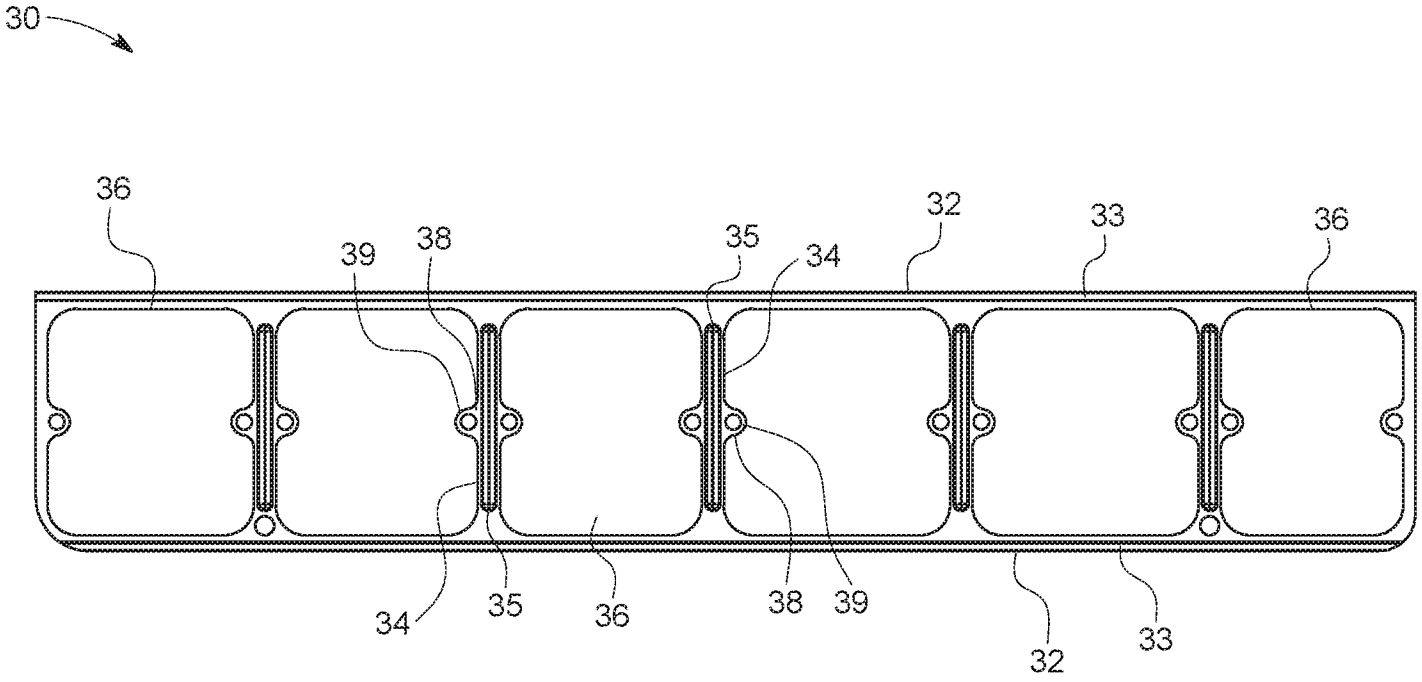
FIG. 8 is a plan view of the carrier of FIG. 7.
Figure 9:
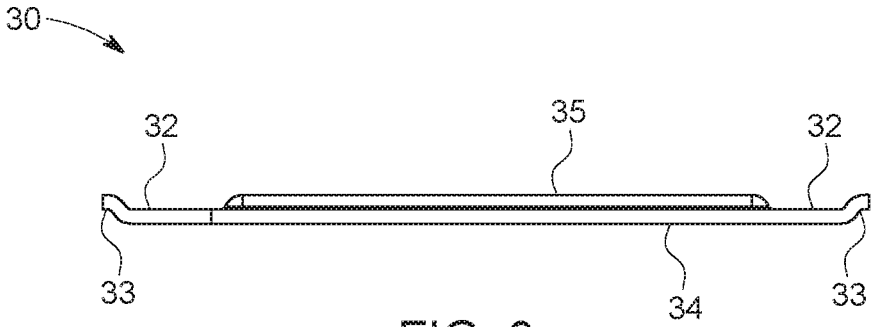
FIG. 9 is a side view of the carrier of FIG. 7

As illustrated in FIGS. 7-9 a carrier or stiffener 30 is stamped and formed from flat sheet metal stock and includes an elongated body portion corresponding to the body portion of the frame 20. In the embodiment shown, the carrier 30 is made from stainless steel, but other formable metals can be used such as aluminum. Additionally, the carrier 30 is not limited to metal, polymers such as PPS which can be molded, machined or extruded with high precision and precise tolerances may also be used. The carrier 30 includes a pair of spaced apart rails 32 and a plurality of cross members 34 extending between the rails 32 that define a plurality of openings 36 along the carrier 30.

The carrier 30 is generally flat and includes a pair of side rails 32 that extend along the entire length of the carrier 20 and a plurality of cross member portions 34 extending between the side rails 32 that define the openings 36. As best shown in FIG. 9 the side rails 32 include a rib 33 formed along the entire length of the side rail 32 that provides stiffening support for the carrier 30 that prevent the carrier 30 from deforming and bending along its length. Each cross member portion 34 also has a projection 35 formed therein as illustrated in FIGS. 8 and 9. The projections 35 that are formed in the cross member portions 34 provide an additional stiffening aspect across the carrier 20 and together with the ribs 33 formed along the side rails 32 maintain a consistent flat surface over the entire carrier 30 and minimize the tendency for the carrier 30 to bend, bow or twist or deform in any other manner.

The rails 32 and the cross members 34 define a plurality of openings 36 formed in the carrier 30, where the location of openings 36 in the carrier 30 correspond to the same general location of the openings 22 formed in the frame 20. Additionally, the ears 38 formed in the cross members 34 extending toward the opening 36 are also aligned with the ears 26 formed in the frame 20. Apertures 39 are formed in each ear 38 of the carrier 30 and in the embodiment shown, the apertures 39 have a circular shape with a center axis. The center axis of the apertures 39 formed in the ears 38 are aligned with the center axis of the apertures 27 formed in the ears 26 of the frame 20 when the frame 20 and the carrier 30 are operatively connected together as shall be discussed.

Figure 10:
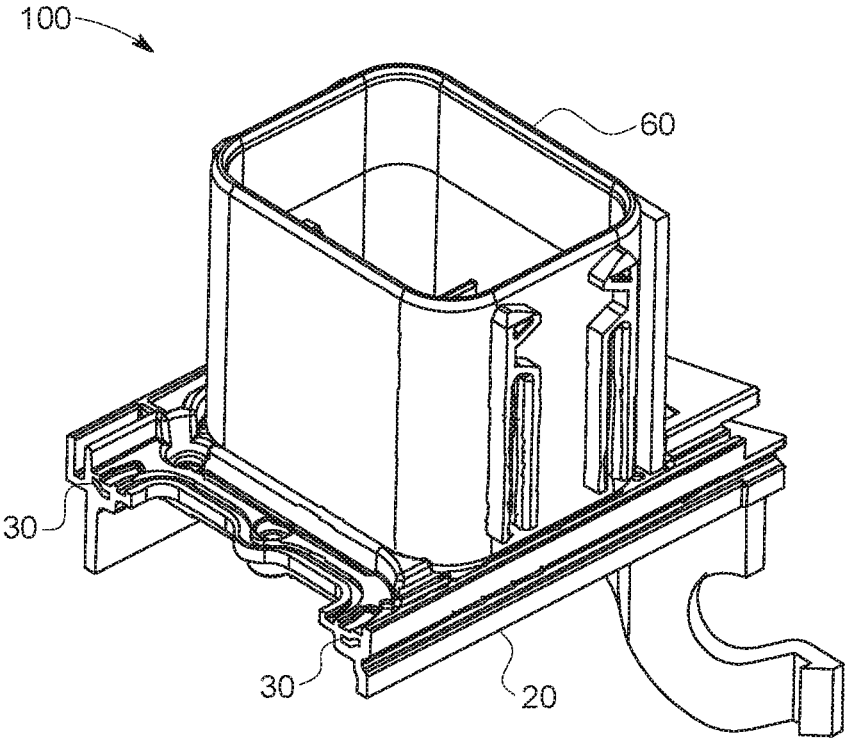
FIG. 10 is detail view of a single bay of the connector of FIG. 1.

As best depicted in FIG. 10 the frame 20 is formed by molding with the carrier 30 integrally embedded within the frame 20, otherwise known as insert molding. This essentially produces a plastic molded part with a second internal metal type skeleton or other rigid/stiff internal skeletal structure. During forming, the carrier 30 is stamped and formed from flat sheet stock into a basic rectangular shape that includes the ribs 33, 35 in the side rails 32 and cross members 34. Stamped and formed components provide improvement over certain imperfections typical of molded components. In this regard, due to the fact that the carrier 30 is stamped and formed from metal, the effects of warpage and moisture absorption along with differential shrink during the molding process of the frame 20 are eliminated with the carrier 30. During the stamping, the openings 36 and the apertures 39 formed in the ears 38 are in precise alignment and the true position between the openings 36 and apertures 39 and from opening 36 to opening 36 along the entire length of the carrier 30 is maintained. This process produces a more precise part compared to molding.

Once the frame 20 and carrier 30 are produced, that is, the frame 20 is molded around the carrier 30, the completed frame 20 with internally molded carrier 30 includes openings 36 in the carrier 30 that are aligned with the openings 22 in the frame 20. Additionally, the apertures 39 formed in the ears 38 of the carrier 30 are aligned with the apertures 27 in the ears 26 of the frame 20. In this arrangement the apertures 39 formed in the ears 38 of the carrier 30. The entire apertures 39 formed in the ears 38 of the carrier 30 are exposed through the apertures 27 formed in the ears 26 of the frame 20, that is, the apertures 27 in the ears 26 of the frame 20 are larger than then the apertures 39 in the ears 38 of the carrier 30. In this case, the entire aperture 39 formed in the ear 38 of the carrier 30 is accessible. In other words, the apertures 39 formed in the ears 38 of the carrier 30 are not blocked or inhibited by any part of the frame 20.

The connector assembly 100 further includes at least one connector module 60. The connector module 60 further includes a housing 62 which is formed from an insulative material generally by molding. The housing 62 includes a base 64, a mounting portion 65 extending in a first direction from the base 64 and a hood 66 extending in a second direction from the base 64. A plurality of conductive terminals 80 are retained in the housing 62, each terminal including a body 82 with a tail 86 extending from the body 82 and a contact 84 extending from the body 82 in another direction. Each terminal 80 is secured in the housing 62 by insert molding or press-fitting. The body 82 of the terminal 80 is secured within the base 64 of the housing 62. The tail 86 extends from the mounting portion 65 of the housing 62 and the contact 84 extends into the hood 66 of the housing 62. The hood 66 is configured to cooperatively connect to a mating connector (not shown). A flange is formed around base 64 of the housing 62 and is configured to engage the lip 28 formed on the edge surface extending around the periphery of each opening 22 in each bay 28 of the frame 20.

Figure 11:
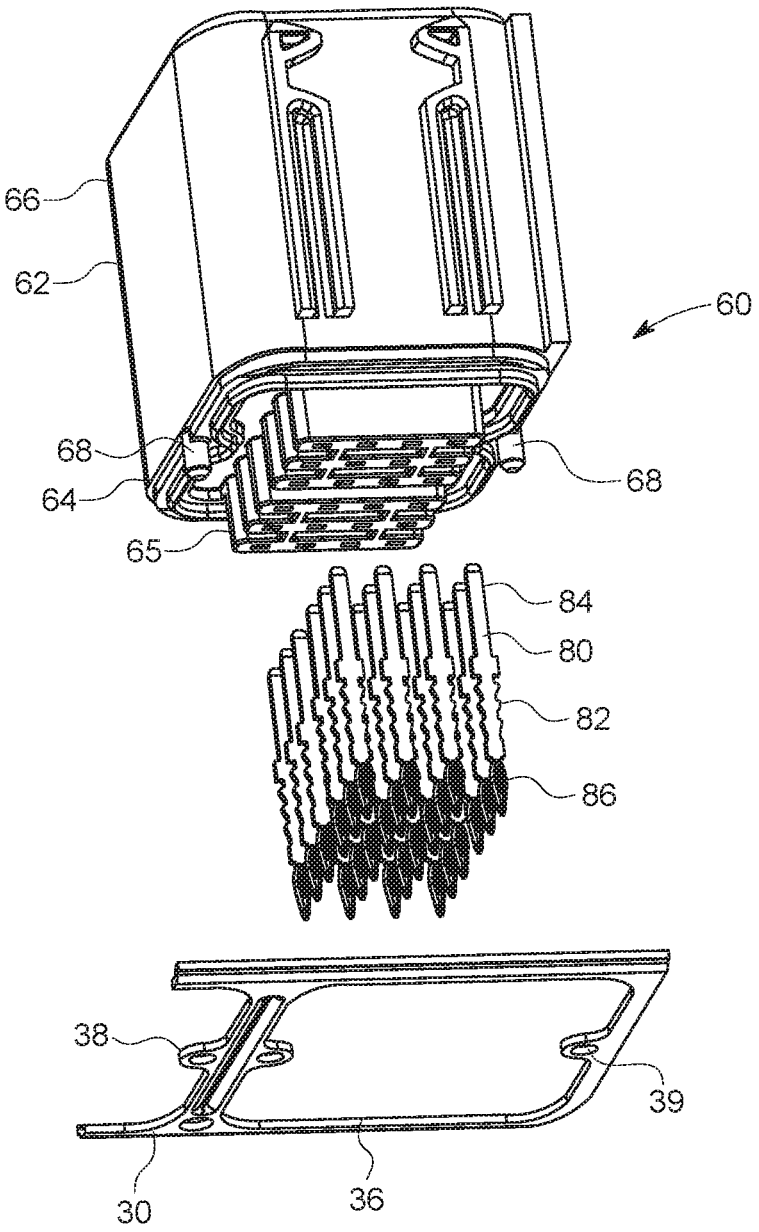
FIG. 11 is an exploded detail view of the a connector module removed from the carrier.
Figure 12:
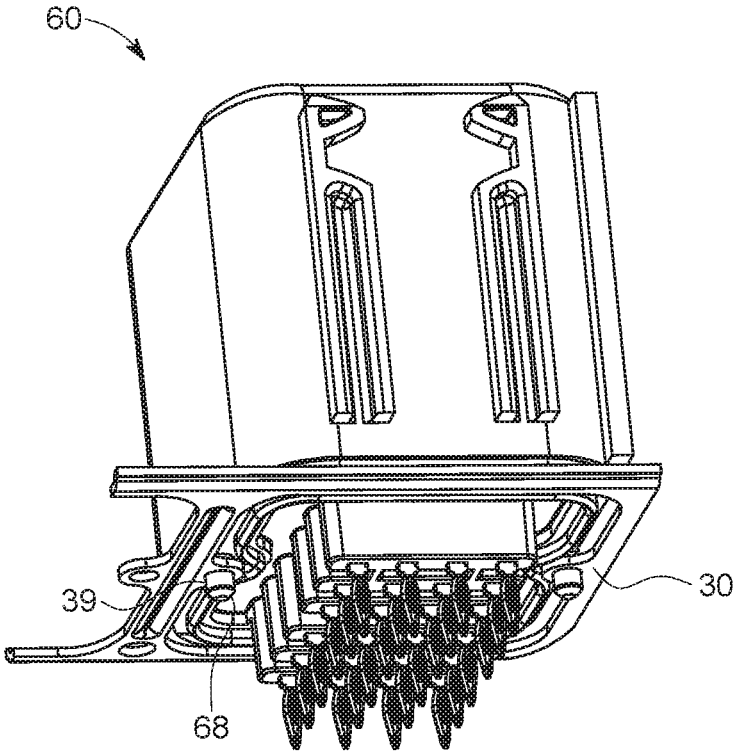
FIG. 12 is a detailed view of the connector module assembled with the carrier.
Figure 13:
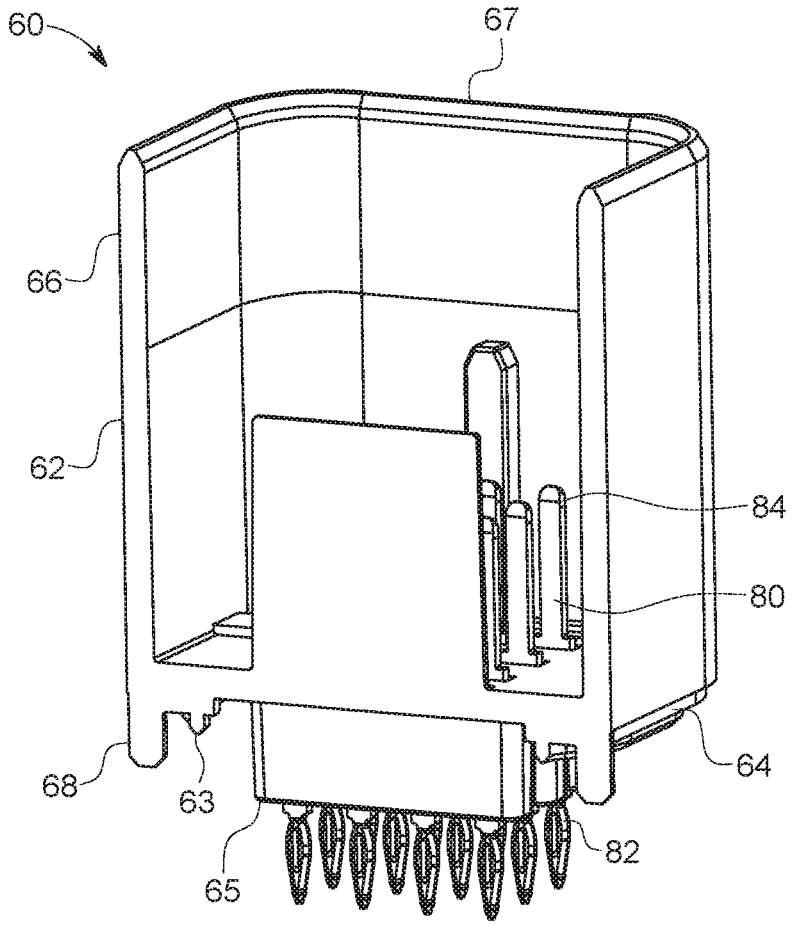
FIG. 13 is a section view of the connector module of the connector of FIG. 1.

As illustrated in FIGS. 10-15 the attachment of the connector module 60 to the frame 20 will be described. As best shown in FIG. 13, a cross section of the connector module 60 is shown. The connector module 60 includes a housing 62 formed from an insulative material with a plurality of electrical terminals 80 secured within the mounting portion 65 of the base 64 of the housing 62. In the embodiment shown, the terminals 80 are arranged in an array and include multiple sized male blade and pin types. The terminals 80 include a contact 84 that is disposed in the opening 67 of the hood 66 of the housing 62, the hood 66 and the opening 67 being configured to mate with a corresponding plug connector (not shown).

The tail portions 82 of the terminals 80 extending from the mounting portion 65 of the housing 62 are configured to be fitted to a printed circuit board (not shown). In the embodiment shown, tails 82 of each terminal 80 are configured with a compliant section such as an "Eye of the Needle, EON" for making electrical connection with conductive vias formed in the circuit board. In alternative configurations, straight tails can be used that extend through holes on the circuit that are soldered to the board. Locating bosses 68 are formed in the mounting portion 64 of the housing 62 that are used to locate the connector module 60 to the carrier 30 embedded within the frame 20. In the embodiment shown, the bosses are shown as circular, but other geometries such as square, triangular or other geometric shape can be appreciated. Each boss may also include crush ribs that act as a point of interference. The footprint or true position of the tails 82 of the terminals 80 is referenced to the bosses 68 formed in the mounting portion 65 in each connector module 60.

As shown in FIGS. 11-12, a portion of the connector assembly 100 is illustrated, note that the frame 20 is not shown for clarity, the alignment of the connector module 60 to the frame 20 (not shown) is dictated by the carrier 30. In other words, the alignment bosses 68 formed in base 64 of the housing 62 are aligned to the apertures 39 in the carrier 30 and are independent from the frame 20. Further, each pair of apertures 39 formed in the ears 38 of the carrier 30 is referenced or toleranced between individual openings 36 in the carrier eliminating cumulative tolerance stack up. Each array of tails 82 is positioned and referenced with respect to the apertures for each opening 36 in the carrier 30. By referencing the arrays of tails 82 to the apertures and referencing the apertures to each other, the tolerance stack-up between the arrays of tails is eliminated. Consequently, since the tolerances in the stamping process can be more tightly held than by molding the variability between the tails 82 is minimized.

Figure 14:
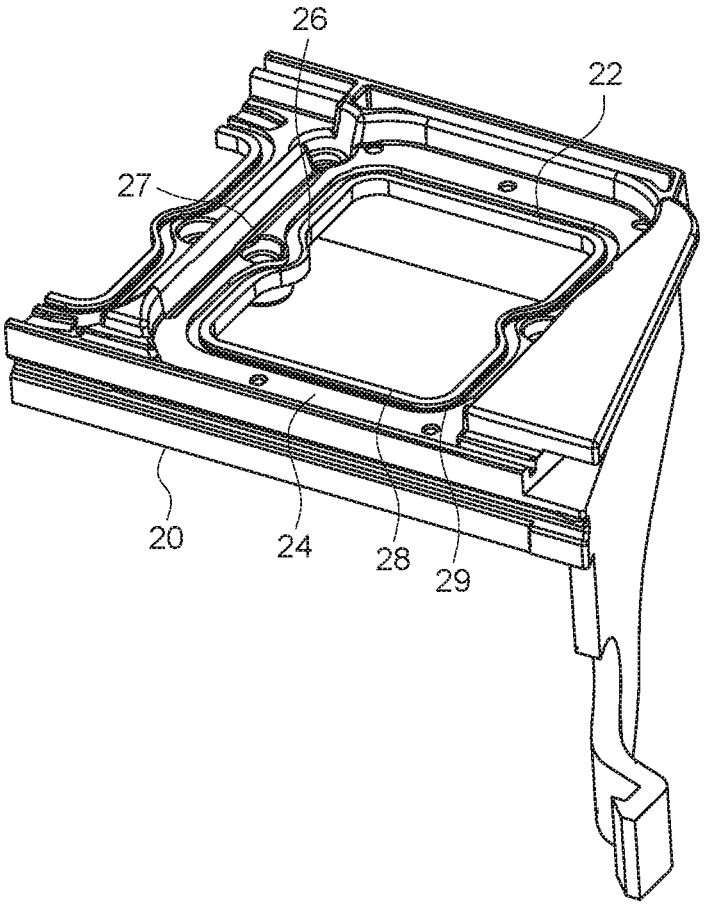
FIG. 14 is a detail view of a single bay of the frame of the connector of FIG. 1.
Figure 15:
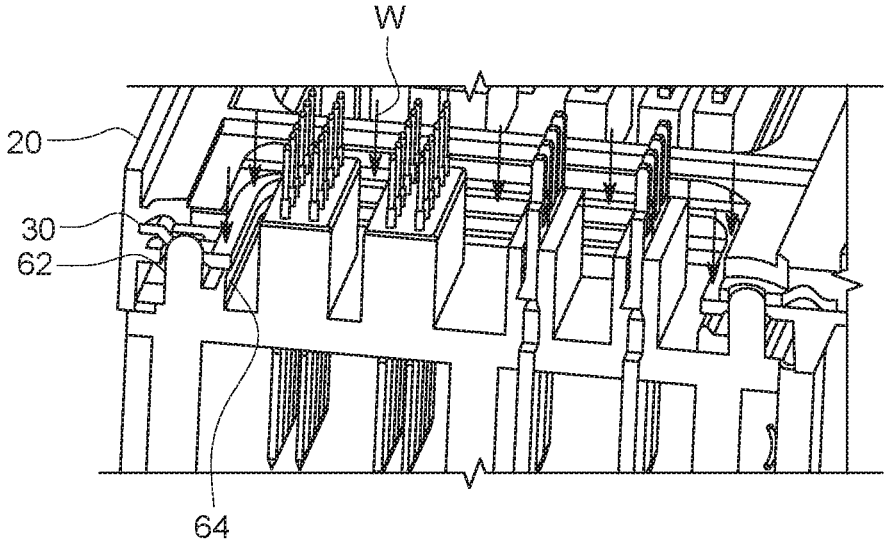
FIG. 15 is a detail cross section of the connector of FIG. 1.

Additionally, as shown in FIG. 13 a weld projection 63 is formed extends from the housing 62 around the periphery of the base portion 64 of the housing 62. As shown in FIG. 14 the frame 20 includes a channel 29 formed in the lip 28 and surrounding the opening 22. The channel 29 and the weld projection 63 maintain the same profile and upon assembly of the connector module 60 to the frame 20, the weld projection 63 is disposed in the channel 29. As illustrated in FIG. 15 the connector module 60 is secured to the frame 20 by ultrasonic welding between the weld projections 63 and the channel 29. As shown, a welding tool is applied to points W along the periphery providing multiple solid connection points along the entire connector module 60. In the embodiment shown, ultrasonic welding is described as a method to retain the connector modules to the frame. Other methods of attachment can also be appreciated; such has adhesive bonding, staking and heat staking, laser welding, friction welding and mechanical fasteners.

With this arrangement, the connector modules 60 are secured to the frame 20 but held in alignment by the carrier 30. The connector assembly 100 provides the advantages of greater dimensional stability and greater adaptability as smaller individual connector modules 60 are easier to produce, they also provide the ability to utilize different electrical terminal arrangements within different connector module 60. Once the connector assembly 100 is completely assembled, the entire assembly 100 is press fitted to a circuit board of a control module or other on board electronic device. The added rigidity of the connector assembly 100, due to the internal carrier 30 or skeleton, aids in the process of pressing the connector assembly 100 to the control module circuit board. As can be appreciated, with large headers or connector assemblies 100, the force needed to press all of the tails of each connector module 60 into electrical engagement with the circuit board of the control module is substantial and during this step, the frame can bend. The added carrier 30 provides additional stiffness so as to reduce the possibility of bending during the pressing operation and therefore aid in ensuring proper electrical contact between the tails 82 and the vias of the control module circuit board.

Additionally, an elastomeric seal (not shown) can be installed on the frame 20. The seal will provide a moisture and debris barrier between the connector assembly and an opening in the casing or external housing of the control module that provides access to the connector modules 60.

It should be noted that, in general, while plug connectors and receptacle receptors have been described as having certain features, the depiction of whether a connector is a plug or receptacle type in the figures is done merely for illustrative purposes. Therefore, it is envisioned that a particular connector could be configured to be a plug or a receptacle type or a combination of plug and receptacle, as desired. Therefore, unless specifically noted, the determination of whether a contact is a receptacle or plug is not intended to be limiting. It should also be noted that directions such as top, bottom, front and rear are arbitrary and are used to provide a clearer understanding of the embodiments shown.

It will be understood that there are numerous modifications of the illustrated embodiments described above which will be readily apparent to one skilled in the art, such as many variations and modifications of the compression connector assembly and/or its components including combinations of features disclosed herein that are individually disclosed or claimed herein, explicitly including additional combinations of such features, or alternatively other types of contact array connectors. Also, there are many possible variations in the materials and configurations.

The invention claimed is:

1. A connector comprising:

a connector module, the connector module including a housing, a plurality of terminals retained in the housing, the housing further including a boss;

a carrier, the carrier including a pair of side portions, the carrier further including cross members that connect the side portions and define an opening, an aperture formed in a cross member;

a frame, the frame configured for operatively securing the carrier, the frame having a second opening corresponding the opening formed in the carrier; and wherein the connector module is attached to the frame, a portion of the housing extends into the openings and the boss formed on the housing engages the aperture formed in the cross member of the carrier to align the connector module to the frame.

2. The connector according to claim 1, wherein the frame is molded around the carrier.

3. The connector according to claim 1, wherein the cross member includes an ear extending toward the opening and the aperture is formed in the ear.

4. The connector according to claim 1, wherein the carrier is made from a material that is stiffer than the material of the frame.

5. The connector according to claim 4, wherein the carrier is made from steel.

6. The connector according to claim 1, wherein the connector module is welded to the frame.

7. The connector according to claim 6, wherein a channel is formed in the frame that surrounds the opening and a projection is formed on the housing of the connector corresponding to the channel and the projection is configured to be received in the channel, the projection welded to the channel.

8. The connector according to claim 1, wherein the carrier includes a stiffening rib.

9. The connector according to claim 8, wherein the rib is formed on the side portion.

10. The connector according to claim 9, wherein the rib is formed on the cross member.

11. The connector according to claim 1, wherein the terminals have press fit tails.

12. The connector according to claim 11, wherein the press fit tails have an eye of the needle.

13. The connector according to claim 1, wherein a seal is operatively connector to the frame.

14. The connector according to claim 1, wherein the terminals are arranged in a vertical fashion.

15. The connector according to claim 1, wherein the boss is cylindrical.

* * * * *